United States Patent [19]

Ross et al.

[11] 4,042,171

[45] Aug. 16, 1977

[54] TRAVEL ENVELOPE CONSTRUCTION HAVING INTEGRALLY FORMED ELONGATED BAGGAGE IDENTIFICATION TAGS

[75] Inventors: Martin I. Ross, New York; Arthur M. Rogers, Far Rockaway, both of N.Y.

[73] Assignee: Exclusive Envelope Corporation, New York, N.Y.

[21] Appl. No.: 703,470

[22] Filed: July 8, 1976

[51] Int. Cl.[2] ..... B65D 27/08

[52] U.S. Cl. ..... 229/72; 40/6; 150/39; 283/20

[58] Field of Search ..... 229/70, 72, 74; 150/39; 283/20, 23; 40/6, 359

[56] References Cited

U.S. PATENT DOCUMENTS

| | | | |
|---|---|---|---|
| 3,164,317 | 1/1965 | Bogen | 229/73 |
| 3,228,129 | 1/1966 | Gwinn et al. | 283/20 X |
| 3,426,961 | 2/1969 | Allison | 229/70 |
| 3,655,119 | 4/1972 | Thompson | 229/72 |
| 3,734,396 | 5/1973 | Cowan | 283/23 X |
| 3,788,540 | 1/1974 | Sammons | 283/20 X |

FOREIGN PATENT DOCUMENTS

| | | | |
|---|---|---|---|
| 2,158,748 | 5/1973 | Germany | 40/6 |

*Primary Examiner*—Stephen P. Garbe
*Attorney, Agent, or Firm*—Philip D. Amins

[57] ABSTRACT

There is provided a new and novel travel envelope construction having integrally formed elongated baggage identification tags and, in selected instances, an integrally formed boarding pass. The envelope construction comprises a right outer panel secured to a left outer panel, in turn secured to a central panel. The central panel is provided with longitudinally disposed elongated and integrally formed baggage identification tags detachable therefrom by means of predeterminedly formed serrations or score lines. The tags are provided with at least one adhesive coated end portion so as to enable the tags to be disposed through, and thence around the handle of an article of luggage or baggage in encircling relationship with respect to the handle, with the tag being secured upon itself by adhesive engagement of the opposed end portions thereof.

42 Claims, 9 Drawing Figures

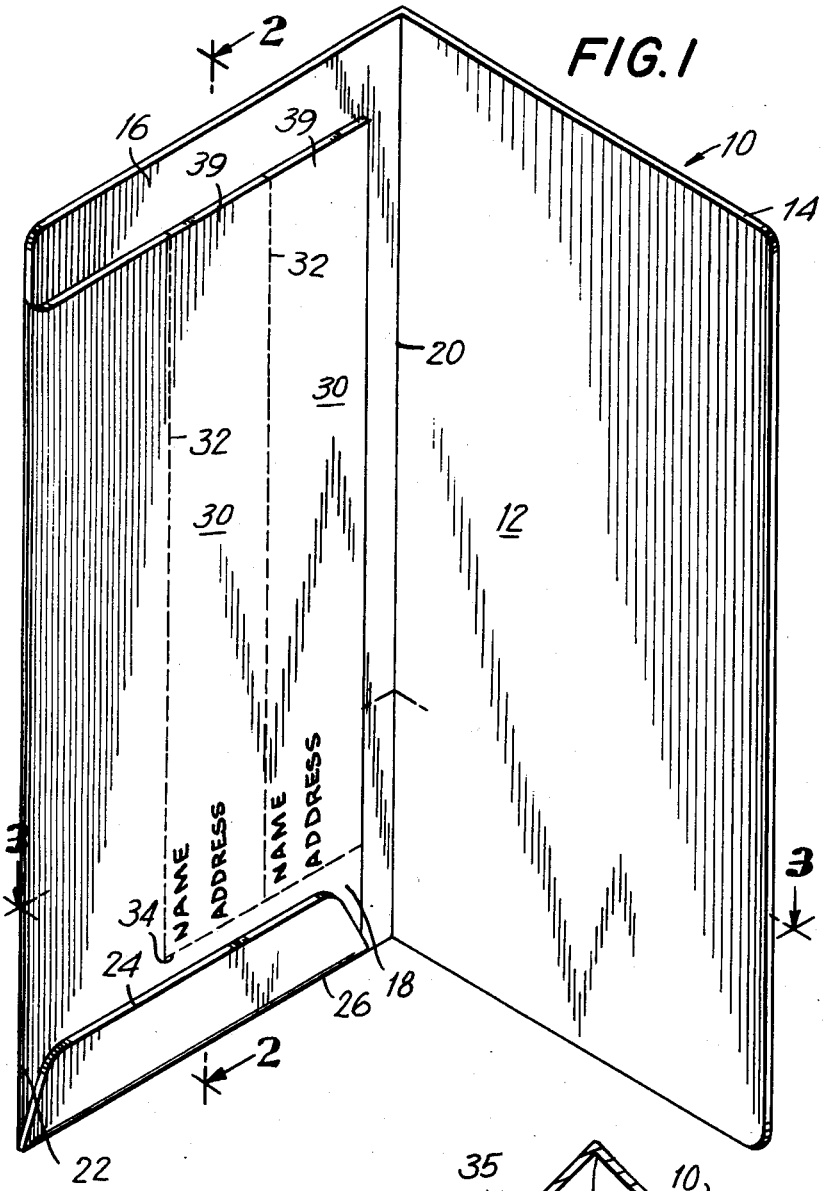
FIG. 1
2
16
39
39
32
32
30
30
20
10
14
12
NAME
ADDRESS
NAME
ADDRESS
34
24
26
18
3
2
22
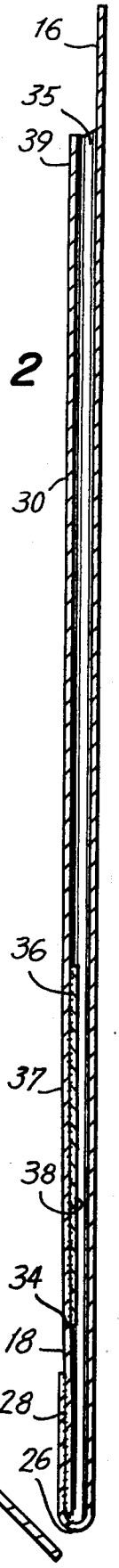
FIG. 2
16
35
39
30
36
37
38
34
18
28
26
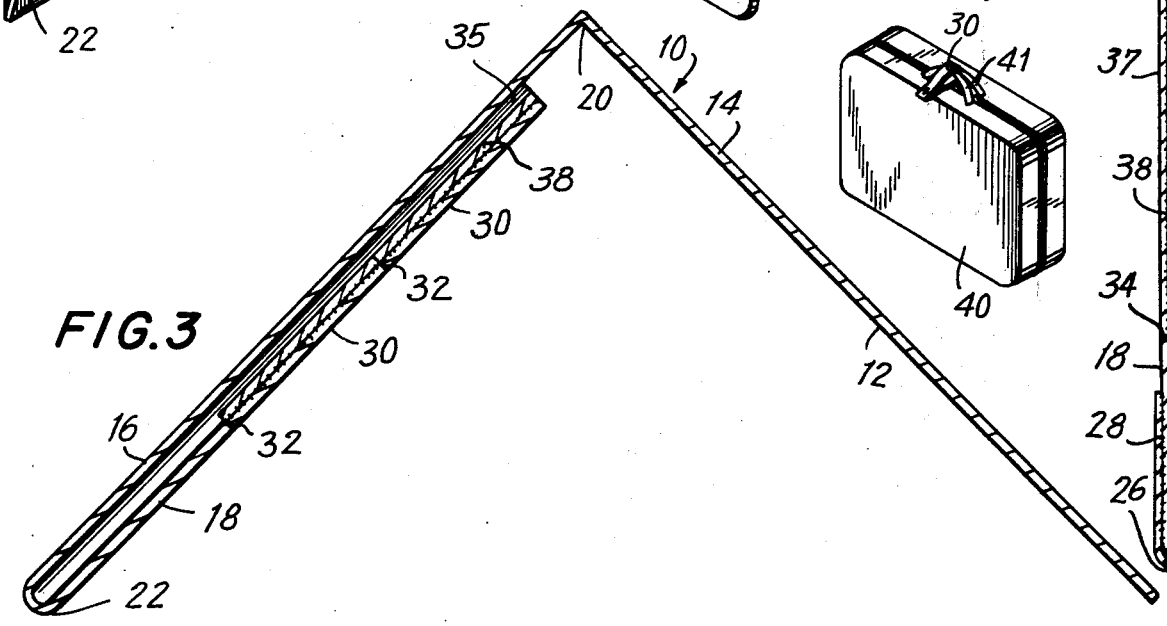
FIG. 3
35
20
10
14
38
30
32
30
16
32
18
22
12
FIG. 4
30
41
40

TRAVEL ENVELOPE CONSTRUCTION HAVING INTEGRALLY FORMED ELONGATED BAGGAGE IDENTIFICATION TAGS

BACKGROUND OF THE INVENTION

The present invention is an improvement of our previous patent application, Ser. No. 631,058, filed Nov. 12, 1975 and entitled TRAVEL ENVELOPE CONSTRUCTION HAVING INTEGRALLY FORMED BAGGAGE IDENTIFICATION LABELS.

The present invention is directed to a new and novel travel envelope construction having integrally formed elongated baggage identification tags and which construction is generally denoted as a wallet-type travel envelope.

Until recent times, there was no real requirement or necessity for providing travel passengers, especially those utilizing airline travel with baggage identification means having provisions to enable passengers to subscribe their names and addresses and to thereafter, secure the same to their articles of luggage. In the past, the airlines provided two-piece numbered tickets wherein one part was secured to the luggage and the other part was retained by the passenger. However, as will be readily apparent to all airline travelers, in the present era, many of the commercially available articles of luggage are so similar in construction, nature and appearance, that it has been exceedingly difficult to recognize one's own luggage without very careful scrutiny.

Accordingly, Federal regulations have recently been enacted stipulating that hereinafter all airline passengers must have name and address indicia on all articles of luggage either put aboard or carried aboard any aircraft. This burdensome task has been assigned to the individual air carriers. In many instances, rolls of identification labels have been provided at the ticket terminals but the act of dispensing them in burdensome, expensive and time consuming.

Although our previously filed application provided a new construction which provides labels having indicia enabling compliance with the applicable laws and tariff regulations, they present a futuristic problem in that the securement of said labels upon a passenger's articles of luggage may incur the displeasure and dissatisfaction of the passenger. This may arise due to the fact that the labels securely adhere to the luggage thereby making the removal thereof difficult and, thus, detract from the aesthetic appearance of the luggage. Moreover, it is also quite possible that after removal of the label, portions of the adhesive coating may remain on the luggage surface and depict a differently colored or toned portion of the surface whose contour would be substantially the same as that of the removed label.

It therefore becomes of paramount importance to provide an envelope construction which provides name and address indicia means which will still comply with applicable Federal regulations, but which will be devoid of any detrimental effect upon articles of luggage.

SUMMARY OF THE INVENTION

Accordingly, it is the primary object of the present invention to provide a new and novel travel ticket envelope construction having integrally formed and detachably secured elongated identification tags which are adapted to be disposed in encircling relationship with the handle of an article of luggage.

It is a more particular object of the present invention to provide a travel ticket envelope of the foregoing type for use by airlines.

It is another object of the present invention to provide the aforedescribed travel ticket envelope construction which is of the wallet-type.

It is a further object of the present invention to provide an airline travel ticket envelope wherein a predetermined number of elongated identification tags are formed integrally with said envelope.

It is still another object of the present invention to provide the aforedescribed travel ticket envelope construction wherein the same is fabricated from a single continuous sheet of material forming a blank.

It is a more specific object of the present invention to provide an envelope construction of the aforedescribed type wherein the envelope comprises left and right outer panels and a central panel which has a specified predetermined number of integrally formed elongated identification tags.

It is another specific object of the present invention to provide the aforesaid elongated identification tags having end portions which are of the self-stick type having release-type backing paper thereon.

BRIEF DESCRIPTION OF THE DRAWINGS

The aforedescribed and other objects, features and advantages of the present invention will become more apparent to those skilled in the art from consideration of the detailed description hereinafter in conjunction with the accompanying drawings, wherein:

FIG. 1 is a perspective view of a first embodiment of the present invention depicting an opened travel ticket envelope of the wallet-type having integrally formed and detachably secured elongated identification tags;

FIG. 2 is a sectional view of the envelope construction of FIG. 1 taken along the line 2—2 thereof;

FIG. 3 is a sectional view taken on the line 3—3 of FIG. 1;

FIG. 4 is a perspective view of an article of luggage having one of the elongated identification tags of the envelope construction of FIG. 1 disposed in encircling relationship with the handles of the article of luggage;

DETAILED DESCRIPTION OF THE PREFERRED EMBODIMENTS

Figure 6:
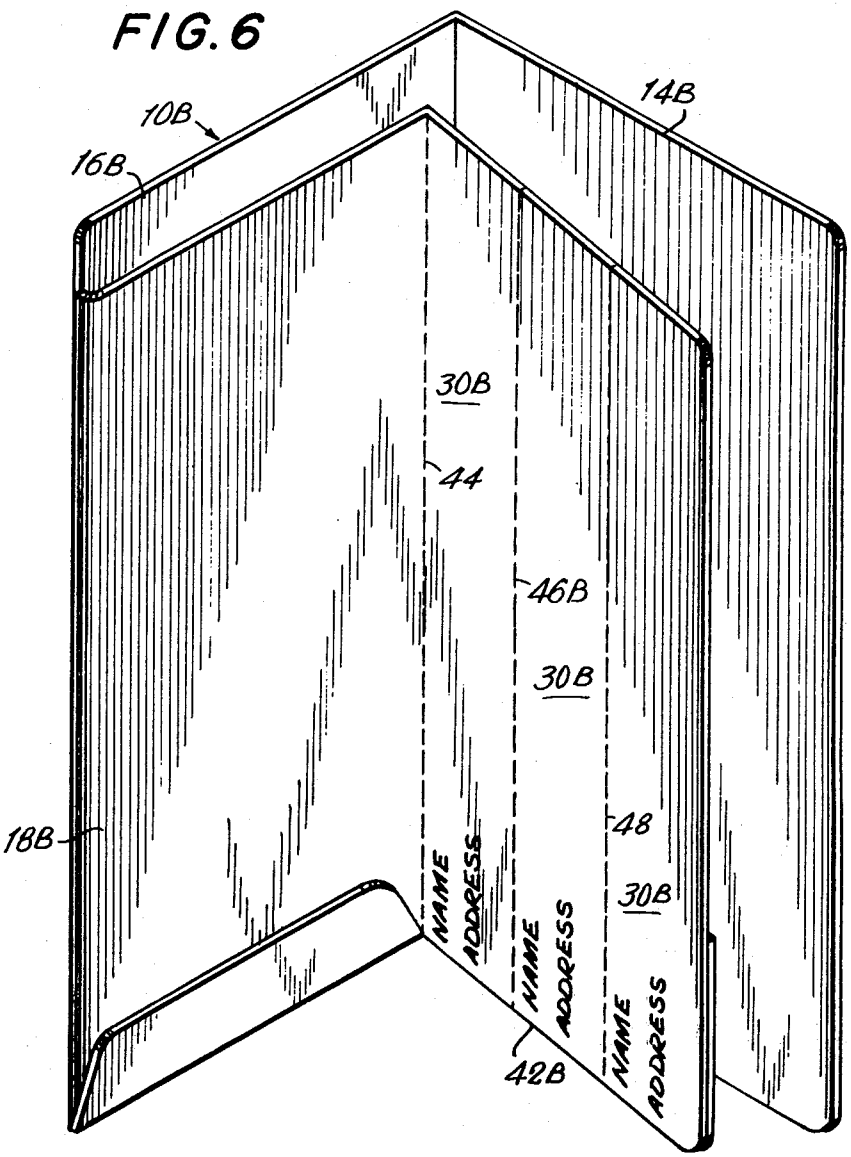
FIG. 6 is a third embodiment of the wallet-type travel ticket envelope constructed in accordance with the principles of the present invention.

Referring now to the drawings, and more particularly, to FIGS. 1 through 3 thereof, there is shown the new and novel wallet-type travel ticket envelope construction comprising the first embodiment and fabricated in accordance with the principles of the present invention.

The envelope is generally denoted by the reference numeral 10 and is fabricated from a single continuous sheet of material 12, which sheet may be described as the blank for forming the final envelope construction. It is herein to be noted that the wallet envelope construction herein is similar to those presently existing and utilized by the airlines for envelope enclosures for passenger tickets and other required papers normally kept by passengers with their airline tickets.

The envelope construction 10 comprises a right outer panel 14, a left outer panel 16 and a central panel 18.

It is to be noted that the reference numerals 14 and 16 may be deemed to denote the right outer panel portion and the left outer panel portion, respectively, of the entire outer panel assembly. The panels 14 and 16 are disposed in contiguous adjacent relationship and are separated by a fold line 20. Similarly, the central panel 18 is connected to the left side portion 16 and is separated by a fold line or bend 22. The bottom portion of the left outer panel 16 is provided with an edge portion or tap 24 which is folded along line 26 and secured to the bottom edge portion of the central panel 18. The tab portion 24 may be secured by means of an adhesive layer 28 interposed between the tap portion and the lower portion of the central panel 18 or by any other known securement means, whether adhesive or otherwise. In this regard, it would also be apparent to those skilled in the art that the bottom portion of the central panel 18 could be secured to the bottom portion of the left outer panel 16 by an adhesive layer interposed between said bottom edge portions or by a thermoplastic layer interposed therebetween or externally thereof by a standardized heat sealing operation thereon. Similarly, the tap portion 24 could be securedly interposed between the left outer panel 16 and the central panel 18.

The central panel 18 is of itself, in like fashion to the envelope 10, of rectangular construction and elongated configuration. In the present embodiment, the central panel 18 comprises two elongated identification tags, generally denoted by the reference numeral 30, having provisions thereon for name and address indicia of a passenger imprinted. The tags 30 are in strip form and are disposed longitudinally along the central panel 18 and are detachable from said central panel by longitudinal and vertically disposed score lines or serrations 32 and lateral and horizontally disposed score lines or serrations 34. The identification tags or strips 30 are partially fabricated from the central panel 18, the same being the imprinted front face thereof. A self-sticking adhesive layer 36 is disposed on the rear surface of the lower end 37 of the tag and a release-type backing paper or sheet 38 is disposed upon and covers the adhesive layer 36 so as to prevent premature and undesirable adhesion of the elongated tags 30, either to the inner surface of the left outer panel 16 or to the airline tickets or any other papers which may be inserted in the space between the central panel 18 and the left outer panel 16 forming the wallet-type pocket denoted by the reference numeral 35. Attention is directed to the fact that no adhesive layer is applied to the opposite, or upper end, 39 of the tags 30.

After a passenger has been issued his tickets, he would then insert the same within the wallet pocket 35 and either at home, at the passenger terminal or at the time of boarding the aircraft, separate either one or both of the identification tags 30 by tearing along the score lines 32 and 34 to the extent necessary to remove the predetermined number of tags desired. It is presumed that the passenger would have already subscribed the required name and address information of said tags.

The passenger would then secure the tag 30 with respect to an article of luggage 40, depicted in FIG. 4, by inserting the tag 30 through one or both of the handles 41 and thereafter peel away the backing substrate layer 38 from the adhesive coated end portion 37, so as to expose the adhesive layer 36. The end portion 37 would then be placed in abuttment with and secured to the opposed end portion 39 by means of the adhesive layer 36. The tag 30 would then be disposed in encircling relationship to the handles 41 and would properly identify the article of luggage, complying with the applicable Federal Aviation Administration regulations and preventing any other passenger from mistaking their luggage from this particular article of luggage by merely referring to the clearly visible identification tag secured thereto.

It will be apparent to those skilled in the art that when the article of luggage has only one handle, the securement of the tag 30 with respect thereto is even simpler than the securement procedure described hereinabove.

Attention is directed to the fact that although two separable, contiguous identification tags have been shown and described herein, it is within the contemplation and purview of the present invention to provide a travel ticket envelope construction having only a singular identification tag. However, it is thought that this narrow and limited construction would not be as useful as the multiple tag variation depicted in FIGS. 1 through 3, which provides greater latitude of use for more passengers; i.e., for those having either one or two articles of luggage.

It is herein to be noted that although the elongated identification tags may be severed from the central panel 18, the central panel still maintains its structural integrity due to the fact that the entire longitudinal left hand portion remains intact and secured to the left outer panel 16.

Figure 5:
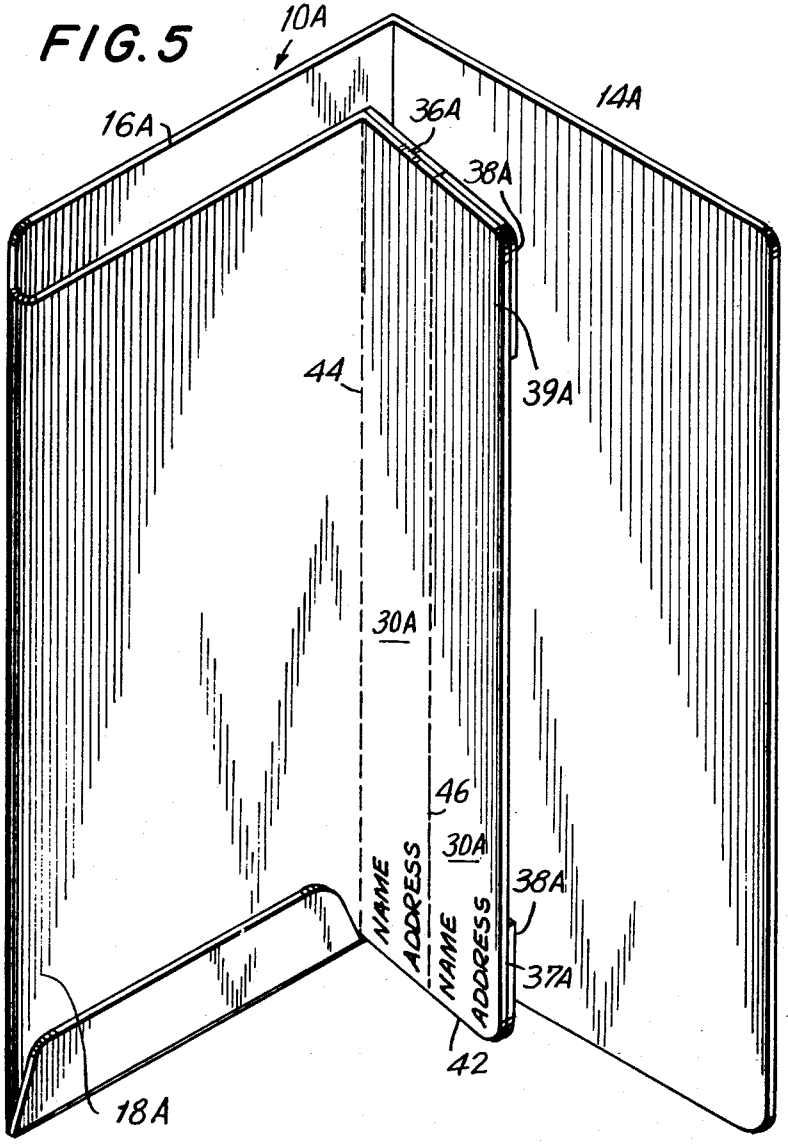
FIG. 5 is a perspective view of a second embodiment of the wallet-type travel ticket envelope of the present invention.

Referring now to FIG. 5 of the drawings, there is depicted a second embodiment of the invention wherein similar reference numerals are used to denote similar parts.

In this embodiment, there is provided a travel ticket envelope construction of the wallet-type designed by the reference numeral 10A, which includes the right outer panel 14A, a left outer panel 16A and a central panel 18A. The panel 18A has a tap portion 42 which is detachably secured thereto by means of a longitudinal and vertically disposed score line or serration 44. The tap portion 42 is provided with another longitudinal and vertically disposed score line 46 dividing said tap portion 42 in half. The tap portion 42 thus provides two identification tags 30A. It will be apparent that the identification tags 30A are of the same construction as the tags 30, as described hereinabove in conjunction with FIG. 1. Thus, when a passenger desires to use the tags 30A, the same is detached from the central panel 18A by first tearing along the score line 46 and thereafter tearing along the score line 44.

In this embodiment of the invention, both the lower and upper end portions 37A and 39A, respectively, of the tags 30A are provided with an adhesive layer 36A. Thus, after detachment of the tags 30A, the backing sheets 38A at the opposed ends 37A and 39A are removed and the ends are adhesively secured to one another in encircling relationship with respect to the handle or handles of an article or luggage.

With regard to FIG. 6, there is shown another embodiment of the wallet-type travel ticket construction of the present invention, which is denoted generally by the reference numeral 10B. The construction 10B includes right outer panel 14B, left outer panel 16B and a central panel 18B. In this embodiment, the tab portion 42B is wider than that of the tab 42 depicted in FIG. 4 and defines and forms three separable and individual identification tags 30B. The construction 10B is provided with a first vertical score line 44B which separates the tab 42B from the central panel 18B, and second and third parallel vertical score lines 46B and 48. The longitudinal score lines 44B, 46B and 48 divide the tab portion 42B into the three separable elongated identification tags 30B, described hereinabove.

Figure 7:
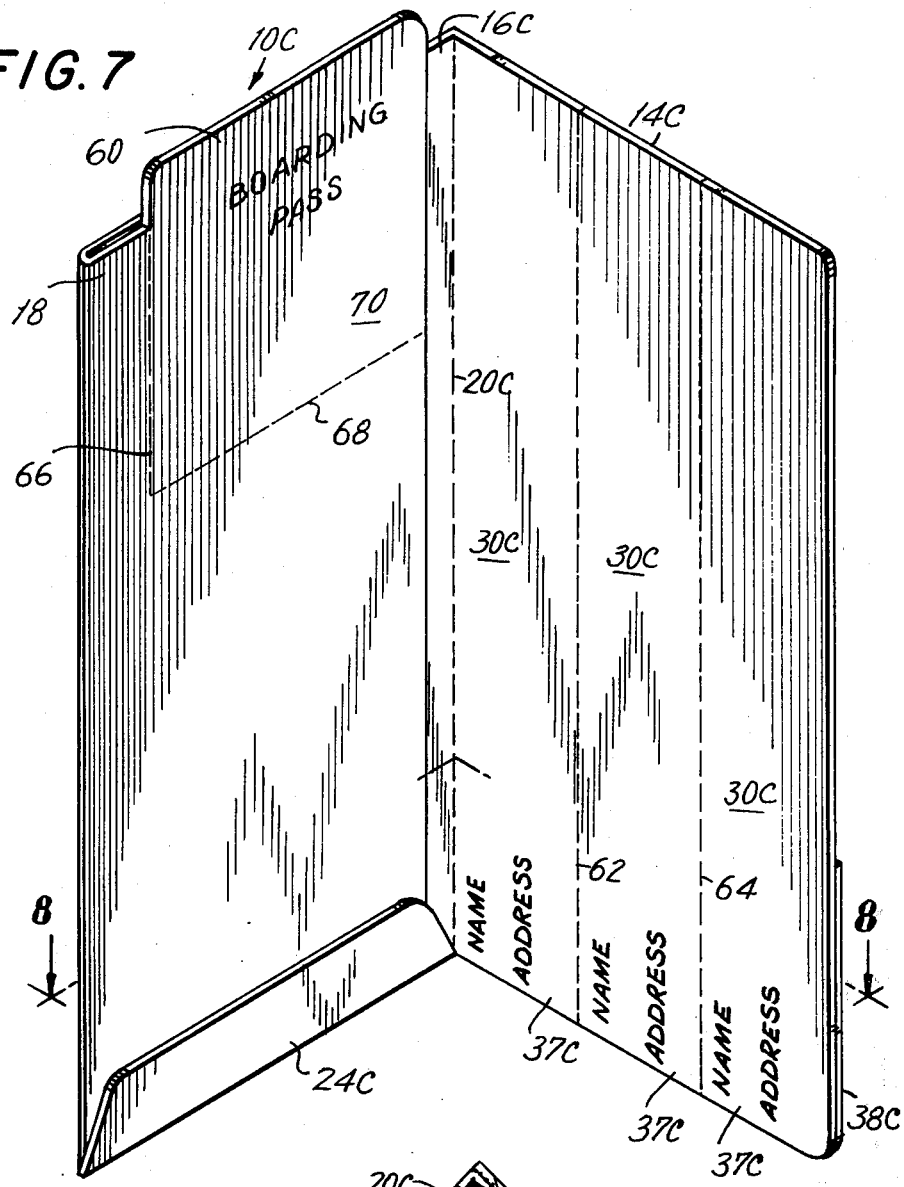
FIG. 7 is a perspective view of a fourth embodiment of the wallet-type travel ticket envelope having an integrally formed boarding pass included therewith.
Figure 8:
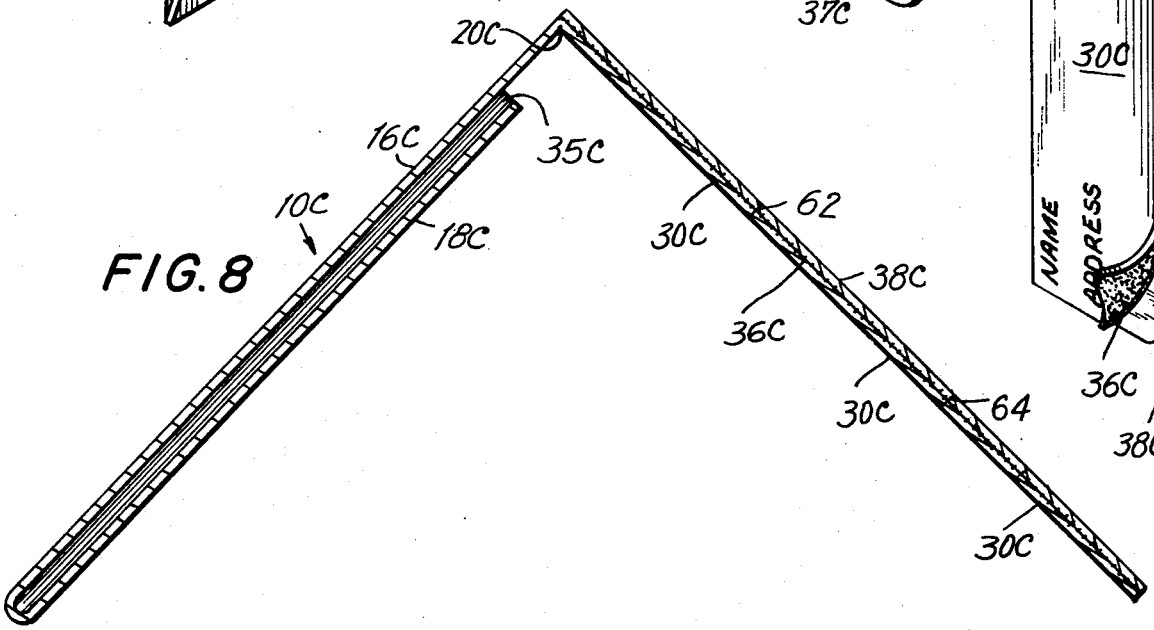
FIG. 8 is a cross-sectional view of the envelope construction of FIG. 7 taken on the line 8—8 thereof.

With reference now to FIGS. 7 and 8, there is depicted another wallet-type travel ticket envelope construction, generally denoted by the reference numeral 10C. In this embodiment, the left outer panel 16C is substantially the same as that described hereinbefore in conjunction with the previous embodiments of the invention. However, the central panel 18C is provided with an upper tab portion 60 which extends beyond the upper edge of the adjoining left outer panel 16C. Of course, the bottom portion of the left outer panel 16C is provided with a lower tab 24C secured to the lower portion of the central panel 18C in a manner similar to that described hereinbefore in conjunction with the previous embodiments of the present invention. The right outer panel 14C is joined to the left outer panel 16C at a folded score line 20C. The right outer panel 14C is also provided with a pair of parallel, vertical longitudinal score lines 62 and 64. The score lines 62 and 64 effectively divide the right outer panel 14C into a plurality of three individual and detachably secured identification tags 30C. Thus, it will be appreciated that the right outer panel 14C has an adhesive layer 36C on the entire lower rear surface thereof and a backing sheet 38C superimposed thereon over the entire extent of said lower right outer panel 14C, which defines the lower portions 37C. It will, therefore, be appreciated that it is very easy and simple for a passenger who does not require the identification tags 30C, or all of the identification tags to open the envelope and obtain the airline ticket or other papers which may be disposed within the wallet pocket 35C by merely grasping the upper tab 60 of the central panel 18C. Additionally, the central panel 18C may be provided with a vertical longitudinal score line 66 and a lateral score line 68, to thereby define a detachable boarding pass 70. The boarding pass 70 is capable of simple detachment from the central panel 18C by a boarding representative or attendant. This is accomplished by grasping of the tab 60 and pulling the same which quickly and easily accomplishes the desired result.

Figure 9:
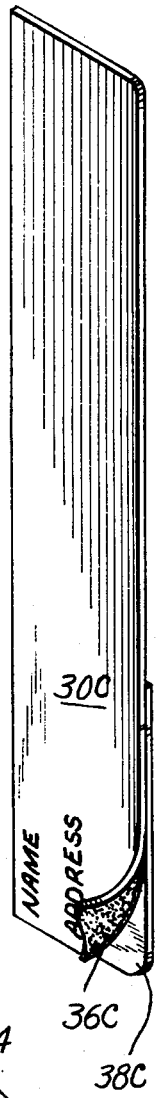
FIG. 9 is a perspective view of one of the elongated identification tags of the envelope construction of FIGS. 1 through 8 depicting the adhesive end portion of the tag being peeled away from the release backing sheet which is coveringly disposed thereon.

As clearly illustrated in FIG. 9, the identification tag is easily readied for use by merely peeling the same away from the backing sheet 38C, so as to expose the adhesive backing layer 36C.

Attention is directed to the fact that in all of the specific embodiments of the invention described hereinabove, all of the envelope constructions are fabricated from a blank comprising a single continuous sheet of material.

It will be readily apparent to those skilled in the art that the present invention provides a new and novel travel ticket envelope construction which is readily adaptable for use by any airline, train, bus, steamship or other transportation carrier, due to the fact that the same simulates those types of envelopes presently in use by said carriers, and which still complies with applicable law by the additional provision of identification tags as an integral part of the envelope construction.

It is to be noted that although the present envelope construction has been shown and described for use as a wallet-type travel envelope and, in particular, as an airline ticket envelope, the use of these constructions is not so limited, as discussed hereinabove. Moreover, the indicia on the detachable identification portions may be other than provisions for name and address information. In this regard, attention is directed to the fact that the indicia on said detachable identification tags may be for reservation information, categorization information or any other desired indicia or required information. Thus, the envelope constructions disclosed and described herein, may be for purposes and utilizations which are other than travel.

While we have shown and disclosed the various embodiments of our invention and the various constructions defining said embodiments, it will be readily apparent to those skilled in the art, that there are many modifications, improvements and changes which can be made therein without departing from the spirit and scope of the invention, as herein discussed and depicted in conjunction with the various preferred embodiments thereof.

What is claimed is:

1. A wallet-type envelope construction comprising
an outer panel having a longitudinal dimension and a lateral dimension, and
an inner panel having a longitudinal dimension and a lateral dimension,
said outer panel being secured to said inner panel along a common edge,
means for securing the bottom edge portion of said inner panel to the bottom edge portion of said outer panel,
said outer and inner panels defining a pocket therebetween capable of having tickets and the like positioned therewithin,
a longitudinally extending portion of said inner panel having name and address indicia thereon to form at least one elongated identification tag,
at least a portion of said longitudinally extending identification tag having an adhesive layer disposed on the rear surface thereof, and
said elongated identification tab being a detachably secured portion of said inner panel.

2. A wallet-type envelope construction in accordance with claim 1, wherein
said identification tag is detachably secured by means of serrations formed on said inner panel.

3. A wallet-type envelope construction in accordance with claim 2, wherein
said serrations are disposed in orthogonal relationship.

4. A wallet-type envelope construction in accordance with claim 3, wherein
said inner panel has at least one free edge, and
at least one side of at least one of said identification tags is formed from a portion of said free edge of said inner panel.

5. A wallet-type envelope construction in accordance with claim 2, wherein
said envelope construction is fabricated from a continuous single sheet of material.

6. A wallet-type envelope construction in accordance with claim 2, wherein
said adhesive layer portion on the rear surface of said identification tag has a releasable backing cover layer disposed thereon.

7. A wallet-type envelope construction in accordance with claim 6, wherein
said adhesive layer portion is disposed on one of the lateral ends of said elongated identification tag.

8. A wallet-type envelope construction in accordance with claim 7, wherein
said one of said lateral ends is the lower end of said elongated identification tag.

9. A wallet-type envelope construction in accordance with claim 6, wherein
said adhesive layer portion is disposed on each of the opposed lateral ends of said elongated identification tag, and
said releaseable backing cover layer is disposed on each of said adhesiver layer end portions.

10. A wallet-type envelope construction comprising
a right outer panel,
a left outer panel, and
a central panel,
each of said right, left and central panels having a longitudinal dimension and a lateral dimension,
said right and left outer panels being secured to one another along a common fold line,
said central panel being secured to one of said right and left panels, such that folding of said right and left outer panels along said common fold line causes said central panel to be disposed therebetween and substantially coextensive therewith,
said central panel and said one of said left and right outer panels to which the same is secured defining a pocket therebetween capable of having tickets and the like positioned therein,
a longitudinally extending portion of said central panel having name and address indicia thereon and forming at least one elongated identification tag,
an adhesive layer disposed on the rear surface of at least a segment of said elongated identification tag portion of said central panel, and
said elongated identification tag portion being detachably secured to the remaining portion of said central panel.

11. A wallet-type envelope construction in accordance with claim 10, wherein
said adhesive layer segment on the rear surface of said elongated identification tag portion has a releasable backing cover layer disposed thereon.

12. A wallet-type envelope construction in accordance with claim 10, wherein
said enlongated identification tag portion is detachably secured by means of serrations formed on said central panel.

13. A wallet-type envelope construction in accordance with claim 12, wherein
said serrations are disposed in orthogonal relationship.

14. A wallet-type envelope construction in accordance with claim 10, wherein
said one of said left and right outer panels has the bottom lateral edge thereof secured to the bottom lateral edge of said central panel.

15. A wallet-type envelope construction in accordance with claim 14, wherein
said bottom lateral edge of said one of said left and right outer panels has a longitudinally projecting bottom lateral edge portion,
a lateral fold line formed in said lateral edge portion, and
means for securing said bottom lateral edge portion to the bottom lateral edge of said central panel.

16. A wallet-type envelope construction in accordance with claim 10, wherein
said central panel is secured to said left outer panel along a common fold line, and
said bottom lateral edge of said left outer panel is secured to the bottom edge of said central panel.

17. A wallet-type envelope construction in accordance with claim 16, wherein
said bottom lateral edge of said left outer panel is provided with a longitudinally projecting lateral edge portion, and
said longitudinally projecting lateral edge portion is secured to the bottom edge of said central panel.

18. A wallet-type envelope construction in accordance with claim 16, wherein
said elongated identification tags are detachably secured by means of serrations formed on said central panel.

19. A wallet-type envelope construction in accordance with claim 18, wherein
said serrations are disposed in orthogonal relationship.

20. A wallet-type envelope construction in accordance with claim 19, wherein said serrations comprise
a plurality of parallel, longitudinal, vertical score lines disposed laterally inward of said common fold line between said left outer panel and said central panel,
a lateral horizontal score line extending to the free inner vertical edge of said central panel, and
said longitudinal and lateral score lines defining at least two detachably secured elongated identification tags.

21. A wallet-type envelope construction in accordance with claim 16, wherein
said adhesive layer segment is disposed on one of the lateral edgs of said elongated identification tag, and
said adhesive layer segment on the rear surface of said elongated identification tag portion has a releasable backing cover layer disposed thereon.

22. A wallet-type envelope construction in accordance with claim 21, wherein
said one of said lateral ends is the lower end of said elongated identification tag.

23. A wallet-type envelope construction in accordance with claim 16, wherein
said adhesive layer segment is disposed on each of the opposed lateral ends of said elongated identification tag, and
said releasable backing cover layer is disposed on each of said adhesive layer end portions.

24. A wallet-type envelope construction in accordance with claim 16, wherein
said central panel has a longitudinal vertical score line formed thereon,
said score line forming a right central tab portion,
at least one longitudinally extending vertical score line formed on said right central tab portion dividing the same into a plurality of elongated identification tags,
each of said tags having an adhesive layer segment disposed on the rear surface thereof, and each of said identification tags having appropriate indicia thereon.

25. A wallet-type envelope construction in accordance with claim 24, wherein said adhesive layered right central tab segments have releasable backing layers disposed thereon.

26. A wallet-type envelope construction in accordance with claim 25, wherein said upper lateral edge of said central panel is longitudinally disposed in recessed relationship with respect to the upper lateral edge of said left outer panel.

27. A wallet-type envelope construction in accordance with claim 16, wherein said upper lateral edge of said central panel is longitudinally disposed in recessed relationship with respect to the upper lateral edge of said left outer panel.

28. A wallet-type envelope construction comprising an outer panel, and an inner panel, said outer panel being secured to said inner panel along a common edge, means for securing the bottom edge portion of said inner panel to the bottom edge portion of said outer panel, said outer and inner panels defining a pocket therebetween capable of having tickets and the like positioned therewithin, a longitudinally extending portion of one of said inner and outer panels having name and address indicia thereon to form at least one elongated identification tag, at least a portion of said longitudinally extending identification tag having an adhesive layer disposed on the rear surface thereof, and said elongated identification tag being a detachably secured portion of said one of said inner and outer panels.

29. A wallet-type envelope construction in accordance with claim 28, wherein said elongated identification tag is detachably secured by means of serrations formed on said one of said inner and outer panels.

30. A wallet-type envelope construction in accordance with claim 29, wherein said serrations are disposed in orthogonal relationship.

31. A wallet-type envelope construction in accordance with claim 30, wherein said one of said inner and outer panels has at least one free edge, and at least one side of said elongated identification tag is formed from a portion of said free edge of said one of said inner and outer panels.

32. A wallet-type envelope construction in accordance with claim 28, wherein said outer panel comprises a left outer panel portion and a right outer panel portion having a common fold line therebetween, and said elongated identification tag portion is formed from said right outer panel portion.

33. A wallet-type envelope construction in accordance with claim 22, wherein said common fold line between said left and right outer panel portions comprises a first longitudinal vertical score line, said right outer panel having at least a second longitudinal vertical score line dividing said right panel portion into a plurality of elongated identification tags, and each of said elongated identification tags having appropriate indicia thereon.

34. A wallet-type envelope construction in accordance with claim 33, wherein said adhesive coated layer portion of said right outer panel portion has a releasable backing layer disposed thereon.

35. A wallet-type envelope construction in accordance with claim 33, including a third longitudinal vertical score line disposed in parallel relationship to said first and second vertical score lines, and said three parallel longitudinal vertical score lines forming three separable and detachably secured elongated identification tags.

36. A wallet-type envelope construction in accordance with claim 33, wherein the bottom lateral edge of said left outer panel portion is provided with a longitudinally projecting lateral edge portion, and said longitudinally extending lateral edge portion is secured to the bottom edge of said inner panel.

37. A wallet-type envelope construction in accordance with claim 33, wherein said inner panel is provided with a longitudinally projecting upper lateral edge portion, and said upper lateral edge portion of said inner panel projects beyond the upper edge of said outer panel portions.

38. A wallet-type envelope construction in accordance with claim 37, wherein said upper lateral edge portion of said inner panel is disposed adjacent said left outer panel portion and projects beyond the upper edge thereof.

39. A wallet-type envelope construction in accordance with claim 28, wherein said inner panel is provided with a longitudinally extending upper lateral edge portion, and said upper lateral edge portion of said inner panel projects beyond the upper edge of said outer panel portions.

40. A wallet-type envelope construction in accordance with claim 39, wherein said inner panel has a longitudinal vertical score line disposed laterally inward of said common edge between said outer and inner panels, a lateral score line intersecting said longitudinal score line and extending to the free inner vertical edge of said inner panel, and said inner panel portion defined by said intersecting score lines forming a detachable boarding pass.

41. A wallet-type envelope construction in accordance with claim 40, wherein said longitudinal vertical score line is disposed in coplanar vertical alignment with the inner vertical edge of said longitudinally extending upper lateral portion.

42. A wallet-type envelope construction in accordance with claim 41, wherein said outer panel comprises a left outer panel portion and a right outer panel portion having a common fold line therebetween, said elongated identification tag portion is formed from said right outer panel portion, and said upper lateral edge portion of said inner panel is disposed adjacent said left outer panel portion and projects beyond the upper edge thereof.

* * * * *